US005658134A

United States Patent [19]

Gagnon et al.

[11] Patent Number: 5,658,134

[45] Date of Patent: Aug. 19, 1997

[54] COMPRESSOR WITH SUCTION VALVE IN PISTON

[75] Inventors: James J. Gagnon, Carrollton; Howard G. Westerman, Richardson; Paul H. Bergthold, Longview, all of Tex.

[73] Assignee: J-Operating Company, Dallas, Tex.

[21] Appl. No.: 507,765

[22] Filed: Jul. 26, 1995

[51] Int. Cl.[6] ..... F04B 3/00; F04B 25/00

[52] U.S. Cl. ..... 417/262; 417/266; 417/534

[58] Field of Search ..... 417/262, 266, 417/268, 523, 534

[56] References Cited

U.S. PATENT DOCUMENTS

| | | | |
|---|---|---|---|
| 213,692 | 3/1879 | Richmond . | |
| 745,298 | 11/1903 | Sergeant | 417/266 |
| 1,005,690 | 10/1911 | Carlson | 417/534 |
| 1,180,536 | 4/1916 | Pownall | 417/525 |
| 1,542,248 | 6/1925 | Howe . | |
| 1,602,193 | 10/1926 | Garber . | |
| 1,840,265 | 1/1932 | Spohrer . | |
| 1,935,856 | 11/1933 | Meyer . | |
| 2,038,155 | 4/1936 | Aldridge | 417/525 |
| 2,077,802 | 4/1937 | Martin | 417/268 |
| 2,215,326 | 9/1940 | Janicke | 417/268 |
| 2,295,592 | 9/1942 | McConnohie . | |
| 3,310,001 | 3/1967 | Bickley . | |
| 3,536,424 | 10/1970 | Plos . | |
| 4,012,173 | 3/1977 | Everson, Jr. . | |
| 4,334,833 | 6/1982 | Gozzi | 417/268 |
| 4,345,880 | 8/1982 | Zanarini | 417/266 |
| 4,478,556 | 10/1984 | Gozzi | 417/266 |
| 4,582,304 | 4/1986 | Reichert . | |
| 5,011,383 | 4/1991 | Bennitt . | |
| 5,015,158 | 5/1991 | Bennitt . | |
| 5,051,074 | 9/1991 | Cowan | 417/534 |
| 5,141,413 | 8/1992 | Bennitt . | |
| 5,209,647 | 5/1993 | Bennitt . | |
| 5,271,428 | 12/1993 | Dunn et al. . | |

FOREIGN PATENT DOCUMENTS 786969 3/1935 France .

OTHER PUBLICATIONS

Cooper Drawing of Traveling Suction Valve C6B–14, Cooper Bessmer. 1938.

Brochures: Hoerbiger Corporation of America Ft. Lauderdale, FL.

*Primary Examiner*—Michael Koczo
*Assistant Examiner*—Peter G. Korytnyk
*Attorney, Agent, or Firm*—Drude Faulconer

[57] ABSTRACT

A compressor which provides for minimum clearance in the compression chamber while substantially reducing the heat normally experienced by the piston during the compression stroke of a compressor of this type. The suction valve(s) of the compressor is concentrically mounted in the piston while the discharge valve(s) is concentrically mounted in a stationary position within the cylinder. Since the high heat of compression occurs at the discharge valve, the piston will be much cooler than in prior art compressors of this type which improves the efficiency of the compressor and which substantially extends the operational life of the piston rings.

19 Claims, 2 Drawing Sheets

COMPRESSOR WITH SUCTION VALVE IN PISTON

DESCRIPTION

1. Technical Field

The present invention relates to compressors and in one of its aspects relates to a gas compressor wherein the suction valve is mounted in and is carried by the travelling piston.

2. Background Art

Of the different types of compressors, the reciprocating compressor is probably the most widely-used in transporting gas through pipelines and the like. In most prior art compressors of this type, both the suction (i.e. inlet) and the discharge (i.e. outlet) valves are typically radially mounted in the cylinder heads or within the cylinder, itself. This placement of the valves requires a rather sophisticated machining of the cylinder and/or heads which, in turn, substantially adds to the costs of the compressor.

Further, and possibly even more important, the required placement of such radially-positioned valves directly dictate the minimum "fixed clearance" which can be achieved in a particular compressor (i.e. "fixed clearance" being that volume remaining in the compression chamber when the reciprocating piston is at the end of its compression stroke). As known by those skilled in this art, it is desirable for a compressor to have the smallest amount of fixed clearance as possible since this clearance directly affects the overall efficiency of the compressor.

In order to decrease the machining costs and to substantially reduce the "fixed clearances" normally associated with reciprocating compressors, it has recently been proposed to position the suction valves concentrically within the cylinder while positioning the discharge valve within the reciprocating piston which actually compresses the gas, see U.S. Pat. Nos. 5,011,383; 5,015,158; 5,141,413; and 5,209,647. However, in all known compressors of this type, the discharge valve is positioned in and is carried by the piston while the suction valve is stationary mounted within the cylinder.

While this valving arrangement will substantially decrease the fixed clearance of a reciprocating compressor, real problems still remain in maintaining the overall efficiency of the compressor over extended periods of operation and in avoiding the substantial downtime routinely required in the frequent replacement of the wear or seal rings on the reciprocating piston. For example, due to the heat of compression, the temperature at the discharge valve during a typical, sustained gas compression operation will range between 200°–300° F. Hence, since these prior art compressors have the discharge valve mounted in the piston, the piston, and hence the sealing rings thereon, will be subjected to this high heat which, in turn, severely reduces the life of the rings. This requires relatively frequent replacement of these rings which, in turn, results in increased maintenance costs and in downtime of the compressor.

Also, this heat is transferred from the piston into the cylinder wall as the piston reciprocates to thereby substantially raise the temperature along the length of the cylinder. As the cylinder heats up, its diameter will increase as its length decreases. This causes the cylinder to become "out-of-round" which, in turn, will likely result in substantial leakage between the piston and the cylinder wall which, as will be recognized, will adversely affect the overall efficiency of the compressor.

SUMMARY OF THE INVENTION

In accordance with the present invention, a compressor is provided which allows for minimum fixed clearance in the compression chamber while substantially reducing the heat normally experienced by the piston during the compression stroke of the compressor. More specifically, the present compressor is comprised of a cylinder having heads at either end thereof, each of which has an outlet therein. A discharge valve is concentrically mounted at either end of the cylinder with one of the valves being slidably mounted whereby its position within the cylinder can be adjusted to define the fixed clearance within its respective compression chamber. The other discharge valve has a center bore through which a piston rod is slidably or reciprocatingly positioned.

Fixed onto the piston rod are a pair of pistons which are spaced from each other to thereby form an inlet chamber which, in turn, communicates with intermediately-located inlet on the cylinder. Each piston has wear (i.e. seal) rings thereon and each carries a suction valve which allows flow from the inlet chamber into a respective compression chamber which is formed as a respective piston moves away from its respective discharge valve.

In operation, gas flows through the cylinder inlet and into the fixed inlet chamber between the pistons. As the piston rod moves in one direction within the cylinder towards a first discharge valve, gas in a first compression chamber is compressed until the gas reaches a pressure necessary to open the first discharge valve thereby allowing the compressed gas to flow through the valve and out the respective outlet in the head.

Also, as the gas is being compressed in the first compression chamber by the first piston, the suction valve in the other piston opens so that gas from the fixed inlet chamber can flow into a second compression chamber which exists at the other end of the cylinder. As the piston rod reciprocates within the cylinder, the operation continuously reverses so that the gas in one of the compression chambers is compressed by one piston while the suction valve in the other piston opens to admit gas into the other compression chamber.

In the present invention, the high heat of compression (200°–300° F.) still occurs at the discharge valves but since these valves are stationary in the cylinder and are not carried by the piston as is the case in the known prior art compressors of this type, this heat can be quickly dissipated through the cylinder heads without heating the cylinder to a temperature which would seriously distort the original geometry of the cylinder. Further, since the piston carries the suction valve, the piston is subjected to much lower temperatures (i.e. 80°–120° F.) which alleviates the wear on the piston rings thereby decreasing both downtime and maintenance costs for the compressor.

In a further embodiment, a second cylinder is included which provides three separate stages of compression within the compressor. The second cylinder has a first section defining a first compression chamber and a second section having a reduced-diameter defining a second compression chambe. First section has an inlet which is fluidly connected to the outlets of the first cylinder. A second piston rod carries a second piston which reciprocates within the reduced-diameter section and a spaced first piston which reciprocates within the first section. A suction valve is mounted in and is carried by the larger, first piston.

In operation, as the second piston rod moves toward the end of the first section, the gas in the first compression chamber is compressed until it reaches a pressure sufficient to open the stationary discharge valve whereupon the compressed gas flows through the discharge valve and into the second compression chamber. Upon reversing the direction of the second piston rod, the smaller piston will compress the gas in the second compression chamber until it reaches a preset pressure necessary to open the second discharge valve to finally discharge the gas from the compressor.

BRIEF DESCRIPTION OF THE DRAWINGS

The actual construction, operation, and apparent advantages of the present invention will be better understood by referring to the drawings which are not necessarily to scale and in which like numerals refer to like parts and in which.

BEST KNOWN MODE FOR CARRYING OUT INVENTION

Figure 1:
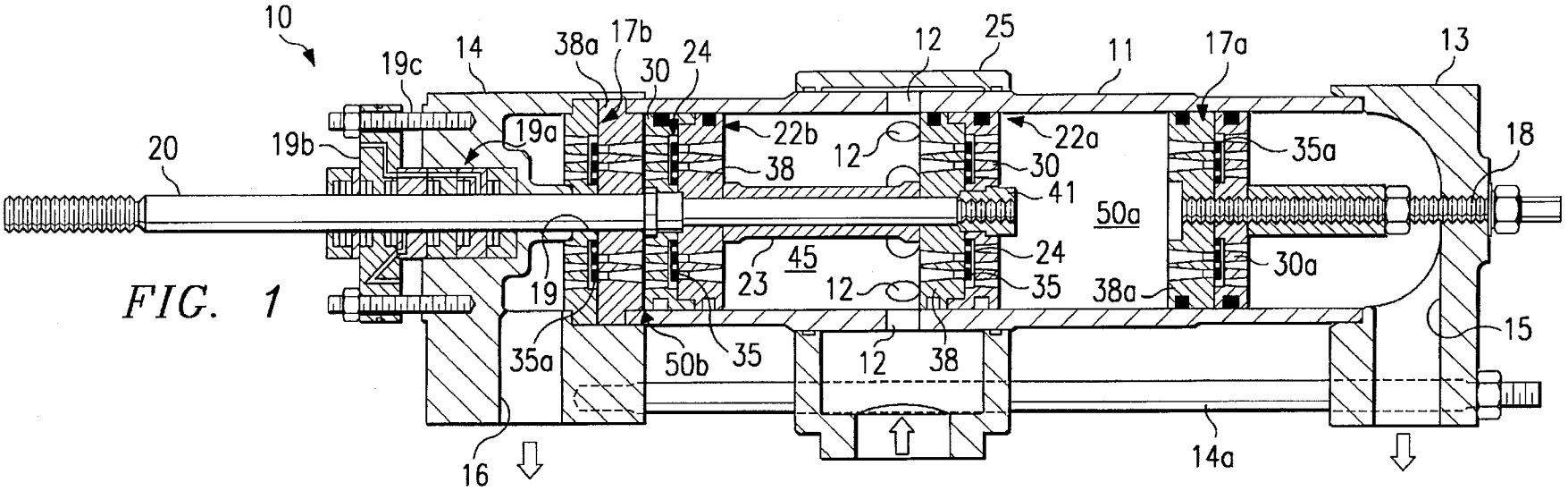
FIG. 1 is a cross-sectional view of a compressor in accordance with the present invention.

In accordance with the present invention, a compressor 10 is provided which provides minimum "fixed clearance" with a compression chamber during the compression stroke while substantially reducing the heat normally experienced by the piston of a compressor of this general type. Referring to FIG. 1, compressor 10 is comprised of a cylinder 11 having a plurality of radially-spaced intake ports 12 intermediate the ends thereof which, in turn, is surrounded by manifold 25. Heads 13, 14 are secured onto the respective ends of cylinder 11 by any appropriate means, e.g. tie-rods 14*a* (only one shown). Each head 13, 14 has an outlet passage 15, 16, respectively, therein for a purpose to be explained later.

Concentrically positioned at either end of cylinder 11 is a discharge (i.e. outlet) valve 17*a*, 17*b*, respectively, which will be described in more detail below. Discharge valve 17*a* is slidably mounted within cylinder 11 whereby its stationary position may be adjustable by means of threaded shaft 18 or the like which operably extends through head 13. As shown, discharge valve 17*b* is mounted in a stationary position between cylinder 11 and head 14 and has a center bore 19, through which piston rod 20 is slidably and reciprocatedly positioned.

Packing 19*a* or the like surrounds rod 20 and is held in place by flange 19*b* and bolts 19*c* or the like. Fixed onto piston rod 20 are a pair of pistons 22*a* and 22*b* which are spaced from each other by spacer 23. Each piston 22 carries a suction valve 24 which will be further described below. The constructional details of both suction valves 24 and discharge valves 17*a*, 17*b* are not critical to the present invention as long as each respective valve allows flow only in one direction and is operable when positioned in a concentric relationship with cylinder 11.

Figure 2:
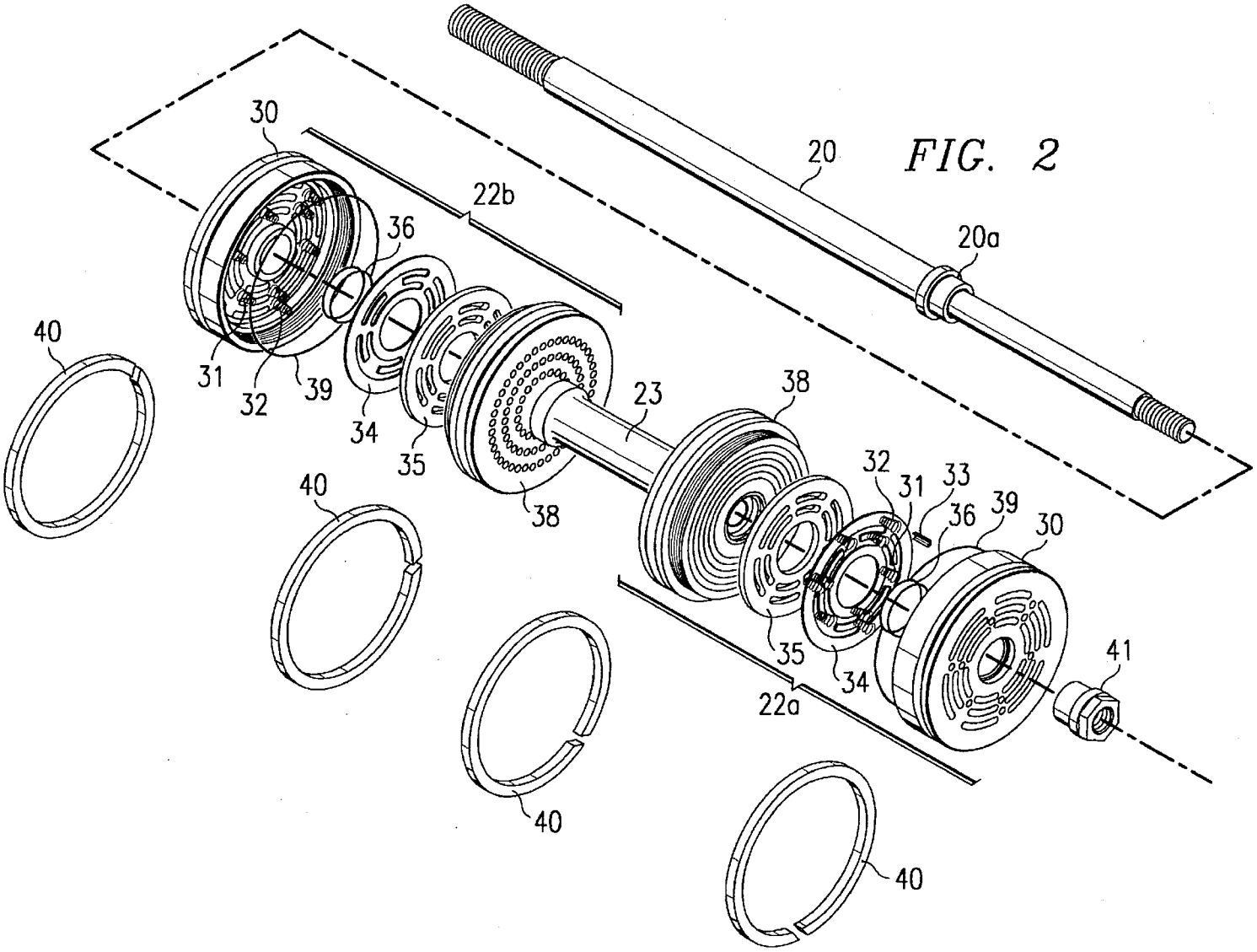
FIG. 2 is an exploded, perspective view of the piston rod and its associated valving of the compressor of FIG. 1.

For example, both the suction valves 24 and the discharge valves 17 can be of the type which are already commercially-available for use in compressors, e.g. "CT" or "CS" Series Valves, Hoerbiger Corporation of America, Inc., Ft. Lauderdale, Fla. This type valve, when used as suction valves 24, is illustrated in an exploded position in FIG. 2 as the suction valve would be assembled onto piston rod 20. Each valve 24 is comprised of a guard housing 30 having closing springs 31 and damping springs (pairs) 32 positioned on respective locator pins 33 therein.

The center bore of guard 30 of the first suction 24 (piston 22*b*) is slid onto piston rod 20 until the housing engages shoulder 20*a* on the rod. Next, damping plate 34 is positioned on rod 20 and into abutment with damping springs 32. Closing springs 31 extend through openings in damping plate 34 to engage valve plate 35 as it is positioned on rod 20 with guide ring 36 aiding in aligning these elements on rod 20. Valve seat 38 then completes the first suction valve 24 with O-ring 39 sealing between the valve seat and guard 30, which can be threaded or otherwise secured together. Combination piston ring/rider bands 40 are positioned onto the outer periphery of the valve to provide a seal between the reciprocating piston and the cylinder wall, as will be understood by those skilled in this art.

Spacer 23 is then positioned onto rod 20 and the elements of the second suction valve 24 are assembled thereon in reverse order after which, nut 41 is threaded onto the end of rod 20 to secure both valves 24 onto the piston rod in their spaced relationship. All of the various valve elements have the appropriate passages therethrough which are aligned to allow flow through the valve when valve plate 35 is not in contact (i.e. not seated) with valve seat 38.

The present compressor 10 operates as follows. Gas flows from manifold 25, through inlet ports 12, and into the fixed inlet chamber 45 between pistons 22*a* and 22*b*. As shown in FIG. 1, rod 20 has moved all the way to the left where piston 22*b* has completed its compression stroke in that direction. Note that at this point, first compression chamber 50*b* is at its smallest volume (i.e. "fixed clearance") which is that volume between discharge valve 17*b* and piston 22*b*.

As piston rod 20 reciprocates to the right in FIG. 1, valve plate 35 seats against valve seat 38 to block flow through valve 24 in piston 22*a*. This allows the gas in chamber 50*a* to be compressed by piston 22*a* until the gas reaches the pressure (e.g. 130 psi) necessary to force valve plate 35*a* away from valve seat 38*a* in discharge valve 17*a* to thereby allow the compressed gas in chamber 50*a* to flow through the valve and out outlet passage 15. As will be understood, valve 17*a* is designed to open when the differential pressure across the valve exceeds a predetermined value (e.g. P of 10 psi).

Also, during the travel of piston rod 20 to the right, valve plate 35 is moved away from valve seat 38 of valve 24 in piston 22*b* whereby gas from the fixed inlet chamber 45 can flow into second compression chamber 50*b*. Now when rod 20 is reciprocated and is again moved to the left, the operation is reversed whereby the suction valve 24 in piston 22*b* closes and discharge valve 17*b* opens when the gas in first chamber 50*b* reaches the preset pressure.

From the above description, it can be seen that, due to the heat of compression, the temperature of the gas (200°–300° F.) is the greatest as it flows through discharge valves 17*a*, 17*b* respectively. By positioning the stationary discharge valves in the cylinder, this high heat can be readily dissipated through the ends of cylinder 11 and heads 13 without seriously distorting the cylinder 11. Also, by positioning the suction valves 24 in the respective travelling pistons, the pistons will only be subjected to moderate temperatures (e.g. 60°–100° F.) during both the intake and compression strokes. This is very important since the lower temperatures experienced by the pistons not only substantially alleviate any distortion of the cylinder but also, substantially extend the operating lives of the combination piston/rider bands or rings 40 thereby decreasing both maintenance costs and downtime normally involved in the frequent replacement of these rings.

Figure 3:
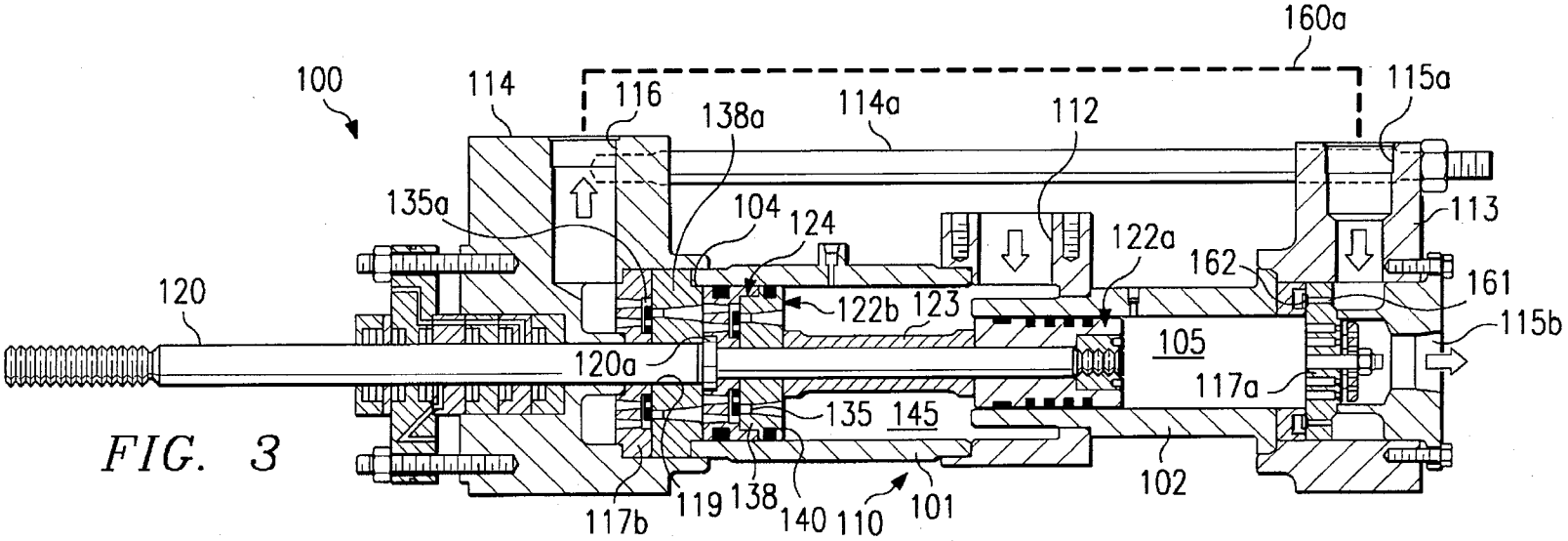
FIG. 3 is a sectional view of a further embodiment of the compressor of FIG. 1.

FIG. 3 discloses a further embodiment of the present invention. Compressor 100 is preferably used in combination with compressor 10 of FIG. 1 to provide three separate stages of compression but for the sake of clarity, compressor 100 will be described as a two-stage compressor. Compressor 100 is comprised of a cylinder 110 which, in turn, has a first section 101 having a first diameter which defines a first compression chamber 104 and a second section 102 having a reduced-diameter which defines a second compression chamber 105. Cylinder 110 may be made as an integral unit or preferably may be made in separate sections and then assembled as shown in FIG. 3. First section 101 has an inlet 112.

Larger diameter section 101 is closed by head 114 which has an outlet passage 116 therein while reduced diameter section 102 is closed by head 113 having both an inlet passage 115*a* and an outlet passage 115*b*. Outlet 116 in head 114 is fluidly connected to inlet 115*a* in head 113 by any suitable means as represented by dotted lines 160*a*. Inlet ports 161, controlled by a valve element 162, or the like, allow gas to flow from inlet 115*a* into compression chamber 105. The heads and cylinder are connected together by any appropriate means such as tie-rods 114*a*.

Discharge valve 117*a* is concentrically mounted in a stationary position at the end of section 102 while discharge valve 117*b* is stationary mounted at the end of section 101. Valve 117*b* has a central bore 119 through which second piston rod 120 slidably passes. Fixed to the outer end of rod 120 is a second piston 122*a* which has a reduced diameter to be received within reduced-diameter section 102.

A first piston 122*b* is positioned on rod 120 and is held in a fixed position against shoulder 120*a* by spacer 123 to form a fixed-volume inlet chamber 145 between the pistons. A suction valve 124 is mounted in and is carried by piston 122*b* which, in turn, has piston rings 140 thereon. The construction and the operation of both suction valve 124 and discharge valve 117*b*, respectively, is basically the same as described above in relation to the embodiment of FIG. 1.

In operation, referring to FIG. 3, piston rod 120 has moved all the way left at which point the first compression chamber 104 is at its smallest volume (i.e. fixed clearance). As the piston 122*b* moved to the left, the gas in chamber 104 was compressed until it reached a pressure sufficient to move valve plate 135*a* from valve seat 138*a* whereupon the compressed gas flowed through discharge valve 117*b*, out outlet 116, through dotted line 160*a*, inlet 115*a*, and into second compression chamber 105. Also, as piston rod moved to the left, gas flowed through inlet 112 into inlet chamber 145 between pistons 122*a* and 122*b*. If used in combination with compressor 10 of FIG. 1, inlet 112 would be connected to the outlets 15, 16 of compressor 10 to receive the compressed gas from compressor 10.

As piston rod 120 is reciprocated and moved to the right, piston 122*a* will compress the gas in second compression chamber 105 until it reaches a preset pressure which then opens discharge valve 117*a* to allowed the gas to flow out of compressor 100 through outlet 115*b*. Also, as piston rod 120 moves to the right, valve plate 135 is moved away from valve seat 138 in suction valve 122*b* to allow gas to flow from inlet chamber 145 into the first compression chamber 104. The operation is continuously repeated as rod 120 is reciprocated within the cylinder 110. Again, by placing the suction valve in the travelling piston, the heat of compression is dissipated at the stationary discharge valves which, as explained above, substantially improves both the efficiency and the operating life of the compressor.

What is claimed is:

1. A compressor comprising:

a cylinder having a first section having a first inlet and a first outlet and a reduced-diameter section having a second inlet and a second outlet;

means for connecting said first inlet to a gas supply;

a first discharge valve having a bore therethrough mounted in said first section of said cylinder for controlling flow from said first section of said cylinder through said first outlet;

a second discharge valve mounted in said reduced-diameter section of said cylinder for controlling flow from said reduced-section of said cylinder through said second outlet;

a piston rod slidably mounted through said bore in said first discharge valve in said cylinder;

a second piston mounted on the end of said piston rod and positioned for reciprocating movement within said reduced section of said cylinder and defining a second compression chamber between said second piston and said second discharge valve;

a first piston mounted on said piston rod and positioned for reciprocating movement within said first section of said cylinder and spaced from said second piston to thereby form an inlet chamber between said pistons which is adapted to receive flow from said first inlet; said first piston forming a first compression chamber between said first piston and said first discharge valve;

a suction valve mounted in and carried by said first piston for controlling flow from said inlet chamber into said first compression chamber; and means for fluidly connecting said first outlet to said second inlet of said cylinder.

2. The compressor of claim 1 including:

a first head mounted on said first section of said cylinder and having a center bore through which said piston rod is slidably mounted; and a second head mounted on said reduced-diameter section of said cylinder.

3. The compressor of claim 2 wherein said first outlet for said cylinder is in said first head and both said second inlet and said second outlet are in said second head.

4. The compressor of claim 3 wherein said first discharge valve comprises:

a guard housing concentrically mounted in said first section of said cylinder;

a valve seat on said guard housing; and a valve plate adapted to seat on said valve seat to block flow through said discharge valve until a predetermine pressure is reached in said first compression chamber which then moves said valve plate away from said valve seat to allow flow from said first compression chamber through said first outlet.

5. The compressor of claim 4 wherein said suction valve comprises:

a guard housing concentrically mounted in said first piston;

a valve seat on said housing; and a valve plate adapted to seat on said valve seat to block flow through said suction valve as said suction valve moves in a first direction towards said first discharge valve and to move away from said valve seat when said piston moves in a second direction away from said first discharge valve to thereby allow flow from said inlet chamber into said first compression chamber.

6. A gas compressor comprising:

a cylinder having a first outlet at a first end and a second outlet at a second end;

a first discharge valve for controlling flow through said first outlet concentrically mounted in said cylinder near said first end, said first discharge valve having a center bore therethrough;

a second discharge valve for controlling flow through said second outlet concentrically mounted in said cylinder near said second end of said cylinder;

a piston rod slidably mounted through said center bore of said first discharge valve;

a first and a second piston fixed on said piston rod at a spaced interval to thereby form an inlet chamber between said pistons;

inlet means intermediate said ends of said cylinder adapted to supply gas into said inlet chamber;

a first suction valve mounted in and carried by said first piston for allowing the flow of gas from said inlet chamber into a first compression chamber which is formed between said first piston and said first discharge valve as said piston rod moves toward said second end of said cylinder; and a second suction valve mounted in and carried by said second piston for allowing the flow of gas from said inlet chamber into a second compression chamber which is formed between said second piston and said second discharge valve as said piston rod moves toward said first end of said cylinder.

7. The compressor of claim 6 wherein said inlet means comprises:

a plurality of openings radially-spaced around said cylinder intermediate its ends; and a manifold surrounding said openings and adapted to be connected to a gas supply.

8. The compressor of claim 7 including:

a first head mounted on said first end of said cylinder and having a center bore through which said piston rod is slidably mounted; and a second head mounted on said second end of said cylinder.

9. The compressor of claim 8 wherein said second discharge valve is slidably mounted within said cylinder, said compressor including:

means for adjusting the position of said second discharge valve within said cylinder to thereby adjust the clearance of the second compression chamber.

10. The compressor of claim 9 wherein said second head has a bore therethrough and said adjusting means for said second discharge valve comprises:

a shaft connected to said second discharge valve and extending through said bore in said second head.

11. The compressor of claim 10 wherein said first outlet is in said first head and said second outlet is in said second head.

12. The compressor of claim 11 wherein each of said first and said second discharge valves comprise:

a housing concentrically mounted in said cylinder;

a valve seat on said housing; and a valve plate adapted to seat on said valve seat to block flow through said discharge valve until a predetermined pressure is reached in its respective compression chamber which then moves said valve plate away from said valve seat to allow flow from said compression chamber to its respective outlet.

13. The compressor of claim 12 wherein each of said first and said second suction valves comprise:

a guard housing concentrically mounted in its respective piston;

a valve seat on said housing; and a valve plate adapted to seat on said valve seat to block flow through said suction valve as said suction valve moves in a first direction towards its respective discharge valve and to move away from said valve seat when said piston moves in a second direction away from said respective discharge valve to thereby allow flow from said inlet chamber into its respective compression chamber.

14. The compressor of claim 13 including:

wear rings positioned around the periphery of said pistons to seal between said pistons and the wall of said cylinder.

15. The compressor of claim 13 including:

a second cylinder having (a) first section having a first inlet and a first outlet and (b) a reduced-diameter section having a second inlet and a second outlet;

means for connecting said outlets of said cylinder to said first inlet of said second cylinder;

a first discharge valve having a bore therethrough mounted in said first section of said second cylinder for controlling flow from said first section of said second cylinder through said first outlet;

a second discharge valve mounted in said reduced-diameter section of said second cylinder for controlling flow from said reduced-section of said second cylinder through said second outlet;

a second piston rod slidably mounted through said bore in said first discharge valve in said second cylinder;

a second piston mounted on the end of said second piston rod and positioned for reciprocating movement within said reduced section of said second cylinder, said first piston defining a second compression chamber between said first piston and said second discharge valve;

a first piston mounted on said second piston rod and positioned for reciprocating movement within said first section of said second cylinder and spaced from said second piston to thereby form a first inlet chamber between said pistons which is adapted to receive flow from said first inlet; said first piston forming a first compression chamber between said first piston and said first discharge valve;

a suction valve mounted in and carried by said first piston for controlling flow from said inlet chamber into said first compression chamber; and means for fluidly connecting said first outlet to said second inlet of said second cylinder.

16. The compressor of claim 15 including:

a first head mounted on said first section of said second cylinder and having a center bore through which said second piston rod is slidably mounted; and a second head mounted on said reduced-diameter section of said second cylinder.

17. The compressor of claim 16 wherein said first outlet for said second cylinder is in said first head and said second outlet for second cylinder is in said second head.

18. The compressor of claim 17 wherein said first discharge valve comprises:

a housing concentrically mounted in said first section of said second cylinder;

a valve seat on said housing; and a valve plate adapted to seat on said valve seat to block flow through said discharge valve until a predetermined pressure is reached in said first compression chamber which then moves said valve plate away from said valve seat to allow flow from said first compression chamber through said first outlet.

19. The compressor of claim 18 wherein said suction valve comprises:

a guard housing concentrically mounted in said second piston;

a valve seat on said housing; and a valve plate adapted to seat on said valve seat to block flow through said suction valve as said suction valve in said first piston moves in a first direction towards said first discharge valve and to move away from said valve seat when said first piston moves in a second direction away from said first discharge valve to thereby allow flow from said inlet chamber into said first compression chamber.

* * * * *